US005324247A

United States Patent [19]

Lepley

[11] Patent Number: 5,324,247

[45] Date of Patent: Jun. 28, 1994

[54] APPARATUS AND METHOD FOR MULTI-AXIAL SPINAL TESTING AND REHABILITATION

[75] Inventor: Jan C. Lepley, Eagle River, Ak.

[73] Assignee: Alaska Research and Development, Inc., Anchorage, Ak.

[21] Appl. No.: 798,598

[22] Filed: Nov. 26, 1991

[51] Int. Cl.[5] ..... A63B 21/00

[52] U.S. Cl. ..... 482/134; 482/8; 482/112; 482/115; 482/136; 482/137; 482/138; 482/903

[58] Field of Search ..... 482/8, 73, 133, 134, 482/136, 137, 908, 112-113, 115-119, 135, 138, 903; 128/25 R, 774

[56] References Cited

U.S. PATENT DOCUMENTS

| | | | |
|---|---|---|---|
| 4,296,924 | 10/1981 | Anzaldua et al. | 482/139 |
| 4,333,340 | 6/1982 | Elmeskog | 482/908 X |
| 4,456,245 | 6/1984 | Baldwin | 482/136 |
| 4,471,957 | 9/1984 | Engalitcheff . | |
| 4,475,408 | 10/1984 | Browning . | |
| 4,628,910 | 12/1986 | Krukowaki . | |
| 4,725,055 | 2/1988 | Skowronski | 482/134 |
| 4,725,056 | 2/1988 | Rehrl | 482/134 |
| 4,733,860 | 3/1988 | Steffee | 482/100 X |
| 4,768,783 | 9/1988 | Engalitcheff . | |
| 4,802,462 | 2/1989 | Reiss et al. | 482/134 |
| 4,828,257 | 5/1989 | Dyer et al. | 482/8 X |
| 4,836,536 | 6/1989 | Jones | 482/134 |
| 4,854,578 | 8/1989 | Fulks | 482/137 X |
| 4,858,919 | 8/1989 | Jones | 482/137 |
| 4,902,009 | 2/1990 | Jones | 482/137 |
| 4,984,986 | 1/1991 | Vohnout | 482/73 X |
| 5,004,230 | 4/1991 | Jones | 482/134 X |
| 5,054,771 | 10/1991 | Mansfield | 482/8 |
| 5,070,863 | 12/1991 | McArthur et al. | 482/134 X |

OTHER PUBLICATIONS

IAN Product News, p. 18.

Assurance Technologies, Inc., May 1, 1991 Price List.

*Primary Examiner*—Robert Bahr

*Attorney, Agent, or Firm*—Arnold, White & Durkee

[57] ABSTRACT

An exercise dynamometer permits a patient to exercise against isodynamic, isokinetic, or isometric resistance to evaluate various musculoskeletal conditions of the patient's human spine. Sensing means are provided to determine the positioning of the patient, and to determine the angular position, velocity, and torque of the exercise movements. In a first embodiment, the patient's head, trunk, upper legs, knees, and feet are secured to a lumbar dynamometer to isolate lumbar and lower thoracic spinal rotation, flexion-extension, and/or lateral bending. During rotational exercise, the axis of movement of the dynamometer is coincident with the patient's spine. In a second embodiment, a patient's trunk and hips are secured to a neck dynamometer to restrict exercise to the cervical spine. The invention facilitates forward flexion-extension, or alternatively lateral bending of the cervical spine, about a first axis aligned with the patient's C1-C2 vertebrae and a second axis aligned with the patient's C7 vertebra.

14 Claims, 4 Drawing Sheets

APPARATUS AND METHOD FOR MULTI-AXIAL SPINAL TESTING AND REHABILITATION

BACKGROUND OF INVENTION

1. Field of Invention

The present invention relates generally to testing systems for evaluating musculoskeletal conditions of the human body. More particularly, the invention relates to an improved system for determining various characteristics of a patient's spine during muscular exertion against dynamic or isometric resistance.

2. Description of Related Art

In the field of exercise physiology, there are a number of different types of resistance to muscular exertion. One category is isometric resistance, which involves attempted motion against a stationary object. During isometric exercise, muscle fibers remain at a constant length.

Isometric resistance has been utilized in the past to analyze the human body. Examples of currently available products that utilize isometric resistance are the ISTU manufactured by Ergometrics Inc. and the Arcon ST by Applied Rehabilitation Concepts. While these systems have been useful for some purposes, they suffer a number of disadvantages.

In particular, testing systems which employ isometric resistance are unable to evaluate certain types of injuries, such as the injuries where a patient only experiences pain during actual movement of an affected body part. Moreover, since isometric systems are static, they are unable to accurately project a patient's actual dynamic lifting capacity. It is well known in the art that the strength of a particular body part varies depending upon the positioning of that body part. Testing systems that employ isometric resistance typically provide a limited number of exercise positions. Therefore, these systems are insufficient to accurately determine a patient's dynamic lifting capacity. Furthermore, since isometric systems do not involve any muscular movement of the patient, these systems lack the capacity to accurately evaluate muscular endurance.

An alternate means for resisting muscular exertion, in contrast to isometric resistance, is dynamic resistance. Dynamic resistance is resistance permitting actual movement of an object by a person exerting force against it. Dynamic resistance involves the shortening and lengthening of the person's muscle fibers. Today it is generally understood that there are three basic types of dynamic resistance: isotonic, isokinetic, and isodynamic.

Isotonic resistance involves the use of gravity or the simulation of gravity to resist muscular exertion. Some examples of exercise equipment utilizing isotonic resistance include free weights such as barbells, as well as Universal brand weight lifting machines. While gravity remains constant, the resistance to a specific muscle in this type of lifting exercise varies during the movement, due to changes in the angle of the lift.

Muscle movement against isotonic resistance occurs in two categories. First, the contractile phase involves shortening the muscle fibers while the weight is moved against gravity, or in other words "lifting" the weight. Second, the eccentric phase refers to motion wherein the muscle fibers are lengthened while the weight is moved in the same direction as the force of gravity, or in other words "lowering" the weight. Although isotonic resistance involves muscle activity in both the contractile phase and the eccentric phase, some exercises utilize what is known as "passive" resistance, wherein a all of a patient's motion is conducted against a counteractive force so that there is no eccentric phase of the exercise.

Exercise machines that provide isotonic resistance by using resistance other than weights are well known in the art. For example, a hydraulic source used to supply isotonic resistance is disclosed in U.S. Pat. No. 4,865,315 to Paterson et al, entitled "Dedicated Microprocessor Controlled Exercise Resistance Machine." In addition to hydraulic sources, isotonic resistance has been provided by pneumatic sources, as illustrated in U.S. Pat. No. 4,257,593 to Keiser, entitled "Pneumatic Exercising Device".

In contrast with isotonic resistance, isokinetic resistance, as now understood, restricts motion to a generally constant velocity, irrespective of the amount of force applied by the patient. Exercise machines that provide isokinetic resistance are well known in the art, and have used a number of different means for resistance. For example, systems are known that provide adjustable isokinetic resistance with mechanical or electric braking devices. Additionally, hydraulic sources have been used to provide isokinetic resistance. An example of an exercise machine that provides isokinetic resistance is the Liftask brand system, which is sold by Lumex Industries. Another example of an apparatus that provides isokinetic resistance to exercise is the Biodex dynamometer sold by Biodex Corp. of Shirley, N.Y. The Biodex machine provides isokinetic resistance for use in quantifying flexion and extension of a patient's lower spine.

Exercise machines that provide isokinetic resistance have been sufficient for some purposes. Specifically, users of exercise or testing machines that utilize passive isokinetic resistance have enjoyed a substantial degree of safety, since they are free to exert as much or as little force against the resistance as they wish without increasing their rate of motion. Furthermore, isokinetic resistance is beneficial since it can be used to determine a patient's strong and weak points in a particular exercise.

In contrast with isotonic and isokinetic resistance, isodynamic resistance, also called isoinertal resistance, provides a constant force or maximum torque during exercise, thereby allowing for changes in acceleration and velocity of motion in proportion to the muscular effort of the user. Although isodynamic devices were also referred to as "isokinetic" during the early 1980's, a distinction between the two has recently been recognized by the industry.

Isodynamic resistance has been useful in a number of applications, and is considered reasonably similar to "real world" lifting conditions, in that velocity changes are permitted to occur. In addition, exercise against passive isodynamic resistance can be conducive to safety since passive isodynamic resistance does not involve muscle movement in an eccentric phase.

Exercise machines providing isodynamic resistance are known in the art. For example, U.S. Pat. No. 4,733,859 to Kock et al, entitled "Exercise Apparatus" utilizes isodynamic resistance in conjunction with neck or foot exercise. Moreover, isodynamic systems have been used to obtain measurements, such as the velocity of the force displaced and the torque on an exercising joint, to evaluate a patient's level of impairment or to evaluate a patient's recovery.

Machines that utilize the various types of isometric and dynamic resistance in exercise or rehabilitation of the spine are well known today. One example of an apparatus that exercises the lumbar and lower thoracic regions of the spine is the Biodex back dynamometer, of Biodex Corp. of Shirley, N.Y. The Biodex back machine provides isokinetic resistance for use in quantifying flexion and extension of a patient's lower spine. Although the Biodex back apparatus is adequate for a number of uses, it has a number of limitations when considered for other purposes. In particular, the only type of dynamic resistance this machine is capable of supplying is isokinetic resistance. Furthermore, the Biodex machine only tests flexion and extension movements of the spine. Accordingly, the Biodex machine cannot facilitate simultaneous multi-axial spinal exercise.

Another example of a machine that utilizes various types of isometric and dynamic resistance in exercise or rehabilitation of the lumbar and lower thoracic regions of the spine is described in U.S. Pat. No. 4,637,607 to McArthur entitled "Drive Unit for Exercising Apparatus". The McArthur device facilitates forward flexion-extension and rotation of the spine. Although the McArthur device is useful in some applications, it is limited for other purposes since it cannot accommodate lateral bending movements and since it does not permit simultaneous multi-axial spinal motion.

Another example of an apparatus that exercises the lumbar and lower thoracic regions of the spine is sold by Isotechnologies, Inc. under the name "Isostation B-200". In contrast to the Biodex dynamometer, the B-200 apparatus supplies passive isodynamic resistance and isometric resistance against rotation, flexion-extension, and lateral bending of the lower spine.

Although the B-200 machine provides a number of benefits to its users, it has several limitations. For example, the B-200 device only facilitates isometric testing in a standing position. However, it is known in the art that such a position does not accurately represent the posture of maximum isometric strength or even a normal lifting posture. The B-200 is also limited because it does not facilitate isokinetic resistance.

Furthermore, although the B-200 machine provides a lateral bending axis that is coincident with the patient's spinal axis for such movement, the B-200 machine suffers a disadvantage in that its axes for forward flexion-extension and rotation are not coaxial with the patient's spine. Specifically, the forward flexion-extension and rotation axes of the B-200 apparatus are located about two to three inches posterior to the spine. Therefore, when the B-200 machine is used to conduct forward flexion-extension or rotation tests with a patient, the results are not as accurate as might be desired since the patient's spine does not coincide with the patient's axes of rotation and forward flexion-extension during the exercise. Accordingly, an improved dynamometer for the lower spine is needed to facilitate rotation and forward flexion-extension exercises about axes that are truly coincident with the spine.

A further limitation of the B-200 machine is that the structure of the apparatus prematurely limits the range of spinal extension. Accordingly, it would be beneficial to have a spinal dynamometer that permits a full range of spinal extension during exercise.

Another limitation of the B-200 machine in some applications is that it cannot properly isolate forward flexion movements of the lower back. Specifically, the patient's torso is harnessed to the B-200 device utilizing an assembly that is slidable linearly during flexion and extension exercises. As a result, the muscles of the lumbar as well the dorsal spine are engaged during such exercise. Therefore, if isolation of the muscles of the lumbar spine is desired during flexion and extension, B-200 machine might be inadequate.

Another disadvantage of the B-200 apparatus is that it does not provide a differential torque setting for the opposing movements of forward flexion and extension. In other words, the B-200 apparatus provides the same resistance for abdominal flexion movements as it does for lumbar extension movements. Typically, a patient's strength in abdominal flexion exercises is generally only 60% of the patient's strength in lumbar extension motions. Therefore, if the patient desires to use a substantial resistance during lumbar exercise, the patient might find the B-200 machine unsatisfactory, since the patient might not be able to overcome such a high level of resistance during the abdominal flexion portion of the exercise.

Another shortcoming of the B-200 machine is that it is not as safe as might be desired since the mass distribution and mechanical configuration of the machine generates a high moment of inertia when a patient engages in high speed exercises against low resistance. As a result, it is conceivable that the machine might swing beyond the patient's range of motion and cause injury. Accordingly, it would be advantageous to have a spinal dynamometer whose structure provides a mechanism for controlling inertia during rotational exercise, especially against lower levels of resistance.

A further disadvantage of the B-200 system is that it does not fully brace the patient's thorax during exercise, and therefore can result in spinal motion that is not properly restricted to the lumbar region of the spine. Moreover, the thoracic bracing provided by the B-200 is often uncomfortable for female patients. Another disadvantage is that the B-200 apparatus does not adequately prevent pelvic movement, especially during rotation exercise. This shortcoming is especially apparent when the B-200 apparatus is used by overweight people. Accordingly, it would be of benefit to have a spinal dynamometer that comfortably and effectively braces an exercising patient's thorax and pelvis to properly restrict to the lower spine area.

In contrast to the above-described machines that exercise the lower region of the spine, there are a number of machines that concentrate on exercising or rehabilitating the cervical or "neck" area of the spine.

One example is U.S. Pat. No. 4,733,859 to Kock et al, entitled "Exercise Apparatus." Kock et al seek to provide an apparatus for exercising the neck muscles, and provide independently adjustable isodynamic resistance against motion about forward flexion-extension, lateral bending, and rotation Another example is disclosed in U.S. Pat. No. 4,768,779 to Oehman, Jr. et al, entitled "Back Exercise Apparatus with a Neck Exercise Attachment." A similar apparatus is shown in U.S. Pat. No. 4,893,808 to Mcintyre et al, entitled "Exercise Apparatus for the Neck." The Oehman, Jr. and Mcintyre machines facilitate neck exercise against adjustable dynamic or isometric resistance about one forward flexion-extension axis, one lateral bending axis, and/or one rotation axis. These machines additionally supply data to facilitate the computerized determination of parameters associated with the exercise, such as angular position, velocity, and torque.

Although the above-mentioned neck exercising machines have been satisfactory for some purposes, they suffer from a common limitation. In particular, the prior neck exercise machines do not account for the non-uniform movement characteristics of the cervical vertebrae and head.

The cervical region of the spine is a complex joint structure. During exercise, the ranges of motion of the various cervical vertebrae are non-uniform. Forward flexion and extension of the neck, for example, is achieved by a complex bending of the cervical vertebra including arching of the first vertebral articulation (the "atlas-axis") as well as flexing of the C2–C7 vertebrae. Lateral bending of the cervical spine similarly requires compound bending of the cervical vertebrae.

Thus, machines that only permit forward flexion-extension or lateral bending about a single axis are sometimes inadequate since they do not facilitate the natural motion of the neck and head. Further, machines that restrict forward flexion-extension or lateral bending to a single axis have limited usefulness in neck testing since they cannot discriminate between the activity of the head and the cervical spine.

Therefore, since the prior neck exercise arrangements discussed above only facilitate forward flexion and/or lateral bending of the cervical spine about a single axis for each exercise, these machines are not as useful as might be desired.

BRIEF SUMMARY OF INVENTION

The present invention concerns an improved system and method for evaluating musculoskeletal conditions of a patient's spine during exercise. The invention comprises a system that facilitates complex bending movements of the spine during exercise to enable more natural motion by the exercising patient and provide more accurate results.

In accordance with a first embodiment of the invention, a lumbar exercise dynamometer includes restraining means for restricting the motion of a patient's legs. In addition, means are provided for restricting the spinal bending of the patient to the lumbar region. The dynamometer permits rotation, forward flexion-extension, and lateral bending of the patient about an axis coincident with the patient's spine.

In accordance with a second embodiment of the invention, a cervical exercise dynamometer includes means for restraining the spinal bending of a patient to the patient's cervical vertebrae. Furthermore, means are provided for restricting bending of the patient's cervical vertebrae to forward flexion or lateral bending about a first and a second axis generally aligned with the patient's C1–C2 and C7 vertebrae, respectively.

DESCRIPTION OF DRAWINGS

With these and other objects in view, reference is now made to the following description taken in connection with the accompanying drawings in which.

DESCRIPTION OF PREFERRED EMBODIMENTS

Figure 1:
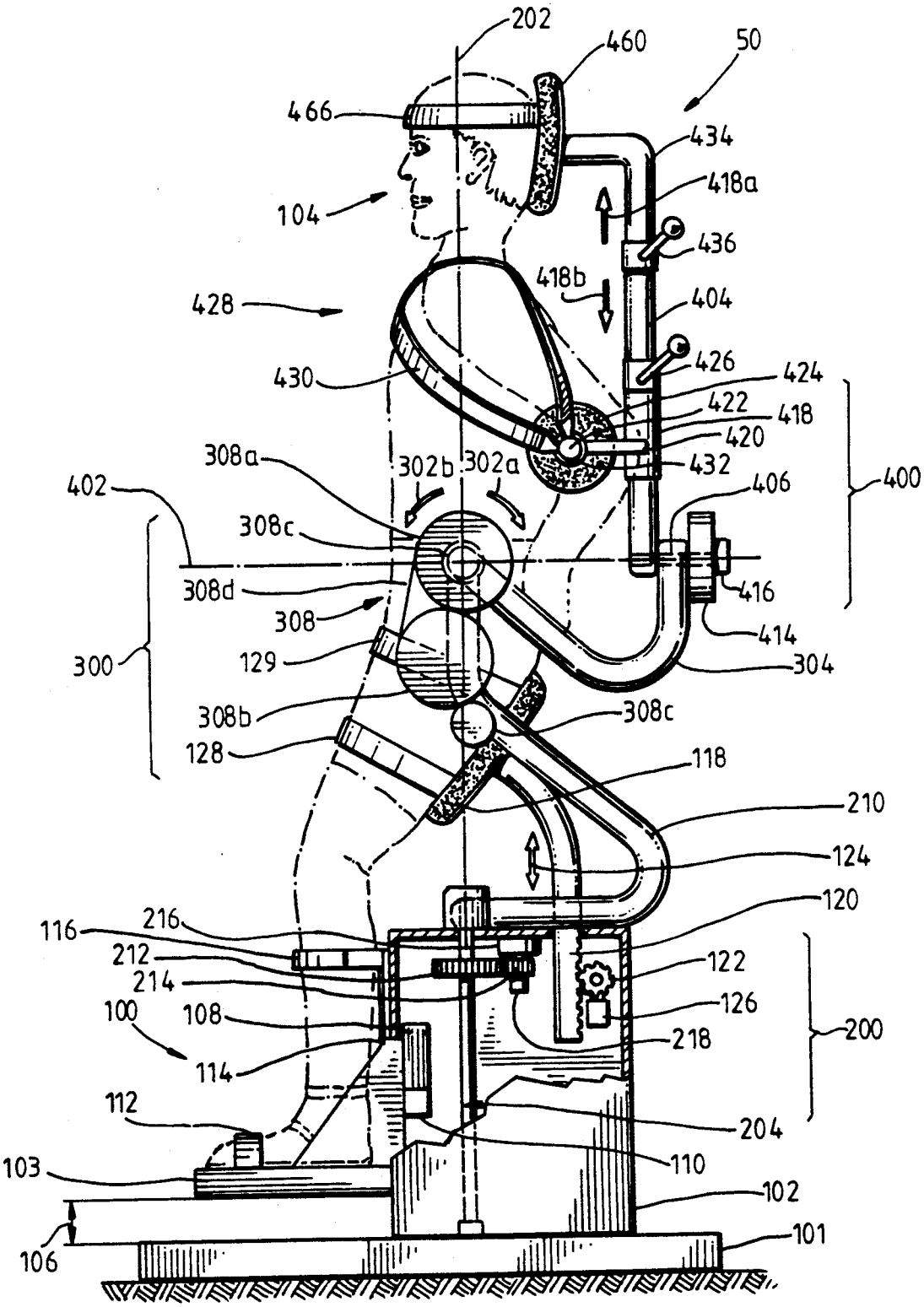
FIG. 1 is a side view of an exercise dynamometer 50 in accordance with a first embodiment of the invention.

The present invention generally provides an improved device and system for evaluating musculoskeletal conditions of the human spine by monitoring different aspects of the spine's motion during exercise against isometric, isokinetic, or isodynamic resistance. Referring to the drawings, a first preferred embodiment of the invention is shown in FIGS. 1–3.

Figure 2:
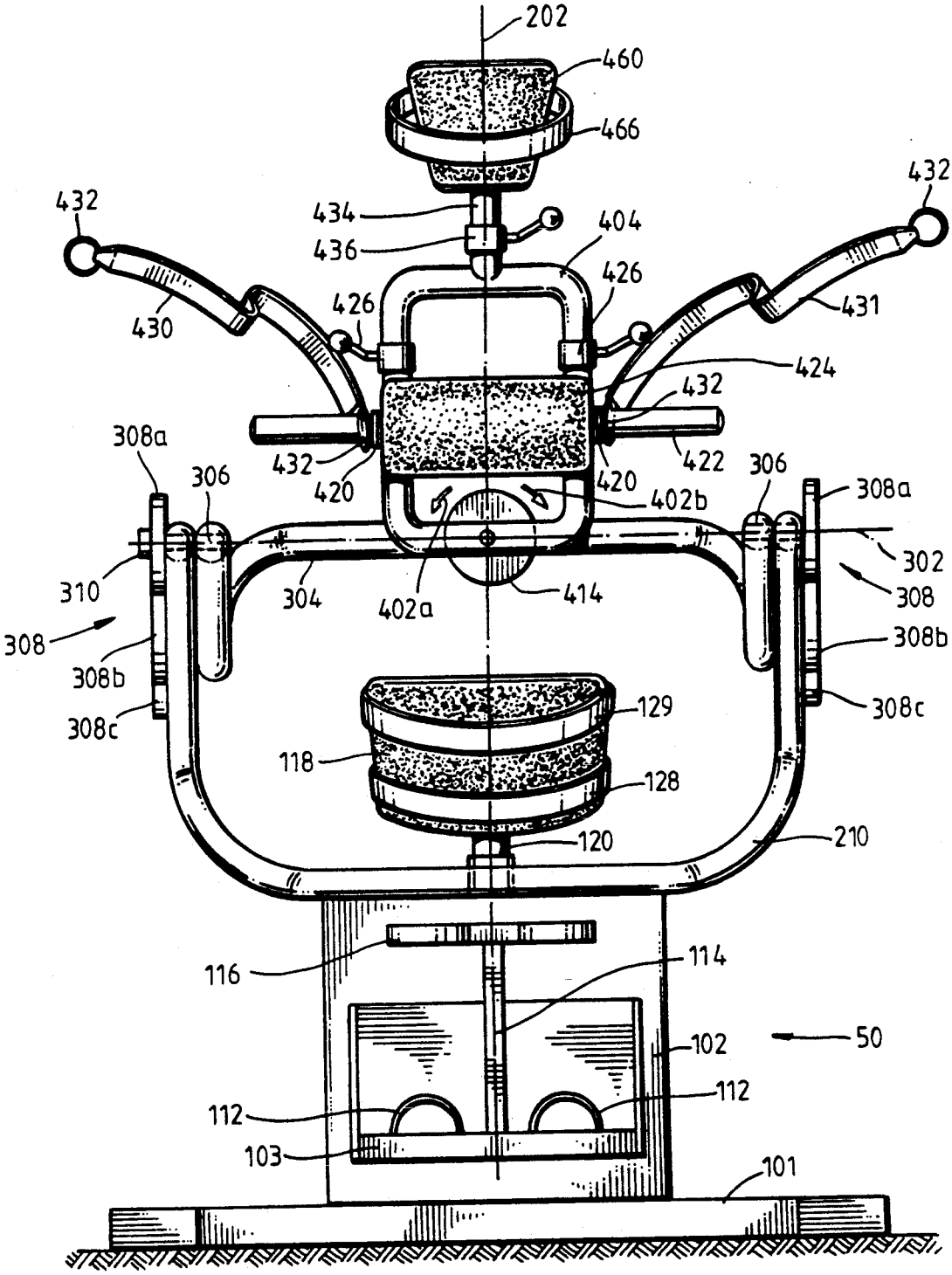
FIG. 2 is a front view of the exercise dynamometer 50 in accordance with the first embodiment of the invention.
Figure 3:
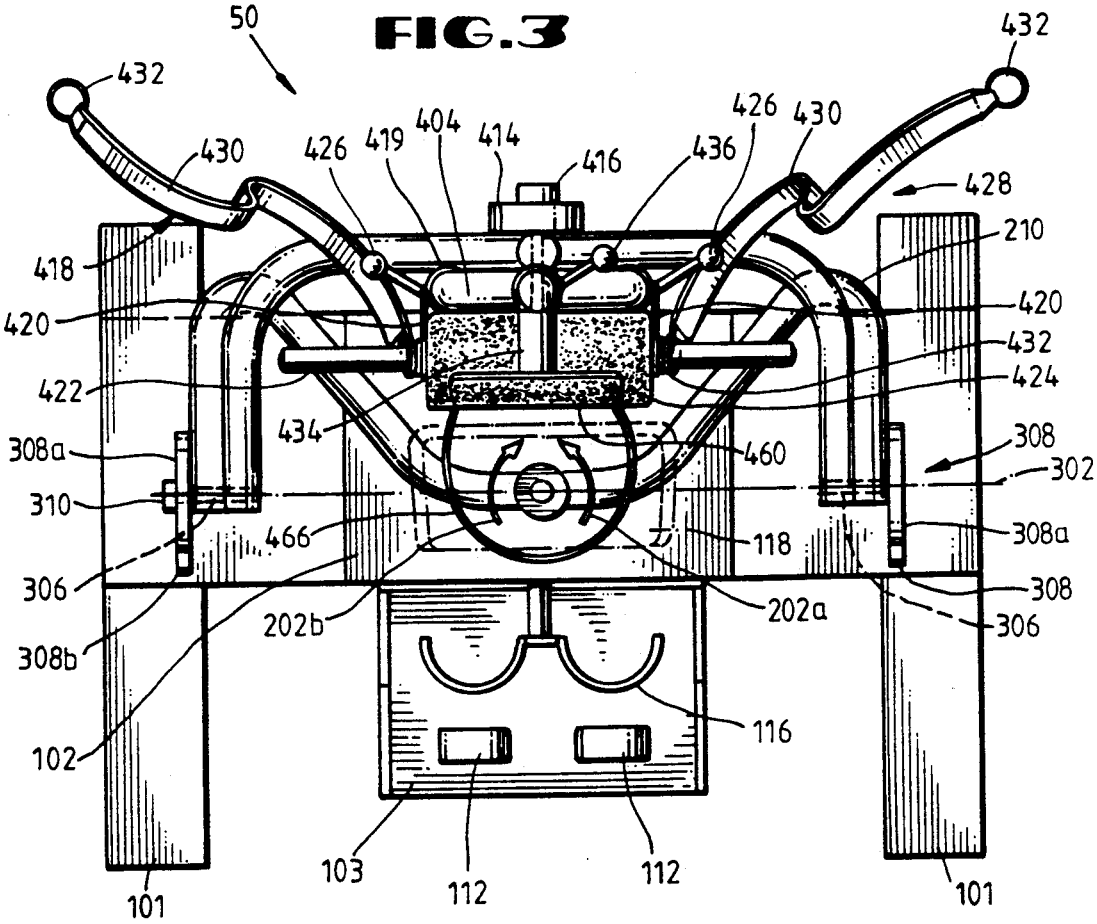
FIG. 3 is a top view of the exercise dynamometer 50 in accordance with the first embodiment of the invention.

A primary component of the first embodiment is a spinal exercise dynamometer 50 shown in FIGS. 1–3 The spinal exercise dynamometer 50 operates like a gimbal, thereby permitting the patient to engage in spinal exercise about one or more axes simultaneously. The spinal dynamometer 50 includes a support unit 100, a rotation assembly 200, a flexion-extension assembly 300, and a lateral bending assembly 400.

Referring to FIG. 1, the support unit 100 provides a central means for interconnecting various components of the spinal exercise dynamometer 50. The support unit 100 includes a base member 101, which provides a stable foundation for the spinal exercise dynamometer 50. A support housing 102, shown in FIG. 1 partially cutaway for explanatory purposes, is connected to and rests upon the base member 101.

The spinal exercise dynamometer 50 also includes a foot platform 103, upon which a patient 104 places his/her feet. The foot platform 103 is slidably engaged with the support housing 102, to permit motion of the foot platform 103 in either direction indicated by an arrow 106. A platform adjusting means 108 is engaged with the foot platform 103 and is mounted to the support housing 102. The platform adjusting means 108 elevates and lowers the foot platform 103.

The platform adjusting means 108 is connected to a platform sensor 110, which comprises an electrical, mechanical, optical, or other type of sensing device suitable for providing an electrical signal indicative of the position of the foot platform 103 with respect to the base member 101 and the support housing 102.

Connected to the foot platform 103 are an adjustable foot restraint 112 and a lower leg brace 114. The foot restraint 112 comprises a device such as a pair of loops, removable bar, or other device fastened to the foot platform 103 for the purpose of firmly preventing motion of the patient's feet with respect to the foot platform 103. The lower leg brace 114 comprises a narrow vertical member to which an adjustable knee restraint 116 is removably connected. The knee restraint 116 comprises a rigid strip that is shaped to accommodate and secure a patient's lower legs when the patient's feet are held in place by the foot restraint 112. The knee restraint 116 is adjustable in height to accommodate a variety of patients. If additional support is desired, the lower leg brace 114 can include belts, straps, or other retaining devices (not shown) suitable to hold the patient's knees in a stationary position during testing with the present invention.

The support unit 100 also includes a perch 118, against which the buttocks and upper legs of the patient rest. The perch 18 is firmly secured to a perch support member 120 which is slidably attached to the support housing 102. The support member 120 is engaged with a perch adjusting means 122 that elevates and lowers the perch 118 in the directions shown by an arrow 124.

The perch adjusting means 122 is further connected to a perch sensor 126, which comprises an electrical, mechanical, optical, or other type of sensing device suitable for providing an electrical signal indicative of the height of the perch 118 relative to the support unit.

An adjustable upper leg restraint 128 is secured to the perch 118. The adjustable upper leg restraint 128 comprises a belt, strap, or other retaining device suitable to hold the patient's upper legs in place with respect to the perch 118. Likewise, an adjustable pelvic restraint 129 is secured to the perch 118 and comprises a belt, strap, or other retaining device suitable to hold the patient's upper legs in place with respect to the perch 118.

Still referring to FIG. 1, the rotation assembly 200 of the spinal exercise dynamometer 50 basically facilitates rotational exercise of the spine about an axis 202 which is coincident with the patient's spine. The rotation assembly 200 also provides various measurements that quantify the rotational exercise.

A primary component of the rotation assembly 200 is a rotation axle 204. The axle 204 is secured within the support housing 102 so as to rotate freely about the axis 202. The axle 204 is firmly fastened to a rotation arm 210, which is also permitted to rotate about the axis 202. FIG. 3, which shows a top view of the spinal exercise dynamometer 50 with the perch 118 removed, more clearly shows the directions of rotation of the arm 210 with arrows 202*a* and 202*b*.

The axle 204 is concentrically fastened to a primary rotation gear 212 having a circular perimeter. The primary rotation gear 212 is engaged with a secondary rotation gear 214, having a rotation resistance means 216 attached thereto. The rotation resistance means 216 may comprise an electromagnetic particle brake, mechanical brake, hydraulic actuator, electric motor, friction brake, pneumatic brake, or other suitable means for providing variable resistance against rotation of the secondary rotation gear 214, thereby resisting rotation of the arm 210.

A rotation sensor 218 is attached to the rotation resistance means 216, and includes two components. The first component comprises an electrical, mechanical, optical, or other type of sensor suitable for providing an electrical signal indicative of the rotational position of the rotation arm 210. The second component is a static torque sensor such as a quartz strain gauge or other type of sensing device capable of detecting the torque produced by the arm 210 during isometric rotation testing, i.e., when the arm 210 does not rotate about the axis 202.

Referring to FIGS. 1-2, the flexion-extension assembly 300 of the spinal exercise dynamometer 50 basically facilitates the exercise of the spine through forward and rearward flexion and extension about an axis 302 which intersects the axis 202 at right angles. The flexion-extension assembly 300 additionally provides various measurements associated with the patient's activity.

A primary component of the assembly 300 is a flexion-extension arm 304. The arm 304 is rotatably attached to the arm 210 about an axis 302 via shafts 306. The assembly 300 includes dual bearings, not shown, located at the intersections between the arms 304 and 210, that facilitate reduced friction in the rotation of the arm 304 in the directions indicated in FIG. 1 by arrows 302*a* and 302*b*.

Dual flexion-extension resistance means 308 are incorporated into the intersections between the arms 210 and 304. Included in each of the resistance means 308 is a primary flexion-extension gear 308*a* attached to one of the shafts 306, a secondary flexion-extension gear 308*b* engaged with the primary flexion-extension gear 308*a*, and a brake 308*c* engaged with the secondary flexion-extension gear 308*b*. Each brake 308*c* comprises an electromagnetic particle brake, mechanical brake, hydraulic actuator, electric motor, friction brake, pneumatic brake, or other suitable means for providing variable resistance against rotation of the arm 304 with respect to the arm 210.

Also included in the flexion-extension assembly 300 is a biasing means. In one preferred embodiment, the biasing means comprises a linear spring 308*d* secured to the circumference of the primary flexion-extension gear 308*a* and the secondary flexion-extension gear 308*b*. The linear spring 308*d* resists forces that elongate the spring, and thus the spring 308*d* urges the arm 304 in the direction of the arrow 302*b*. The linear spring 308*d* is important since, when the spinal dynamometer 50 of the invention is positioned as depicted in FIGS. 1-3, the lateral bending assembly 400 experiences a gravitational force that tends to move the assembly in the direction of the arrow 302*a*. Hence, the biasing means 308*d* compensates for the effect of gravity upon the lateral bending assembly 400 when the spinal dynamometer is in the position of FIGS. 1-3.

An alternate embodiment (not shown) of the dual flexion-extension resistance means 308 is also contemplated. This embodiment includes a primary flexion-extension gear, a brake engaged to the primary flexion-extension gear, and a torsion spring or other apparatus that urges the primary flexion-extension gear in the direction of the arrow 302*b*.

Another component of the flexion-extension assembly 300 is a flexion-extension sensor 310, which is coupled to one of the joints between the arms 210 and 304 and includes two components. The first component comprises an electrical, mechanical, optical, or other type of sensing device suitable for providing an electrical signal indicative of the angular position of the arm 304 with respect to the arm 210. The second component is a static torque sensor such as a quartz strain gauge or other type of sensing device capable of detecting the torque experienced by the joint between the arms 210 and the arm 304 during isometric flexion-extension testing, i.e., when the arms 210 and the arm 304 are stationary with respect to each other.

The lateral bending assembly 400 of the spinal exercise dynamometer 50 shown in FIGS. 1-3 facilitates lateral bending of the spine about an axis 402 and provides various measurements that quantify such exercise.

One of the primary components of the assembly 400 is a lateral bending support segment 404, which is rotatably coupled to the flexion-extension arm 304 by a shaft 406, permitting rotation of the support segment 404 about the axis 402, in the directions shown in FIG. 2 by arrows 402*a* and 402*b*. A lateral bending resistance means 414 is securely coupled to the intersection between the arm 304 and the segment 404. Included in the resistance means 414 is a lateral bending gear (not shown) attached to the shaft 406 and a brake (not shown) engaged with the primary lateral bending gear.

This brake comprises an electromagnetic particle brake, mechanical brake, hydraulic actuator, electric motor, friction brake, pneumatic brake, or other suitable means for providing variable resistance against the rotation of the primary lateral bending gear.

A lateral bending sensor 416 is coupled to the joint between the arm 304 and the segment 404 and includes two components. The first component comprises an electrical, mechanical, optical, or other type of sensor suitable for providing an electrical signal indicative of the angular position of the support segment 404 with respect to the arm 304. The second component is a static torque sensor such as a quartz strain gauge or other type of sensing device capable of detecting the torque experienced by the joint between the support segment 404 and the arm 304 during isometric lateral bending testing, i.e., when the support segment 404 and the arm 304 are stationary with respect to each other.

The assembly 400 additionally includes dual linear bearings 418 which are positioned concentrically about the support segment 404 and adapted to slide linearly in either of the directions shown by arrows 418*a* and 418*b*. The bearings 418 are rigidly interconnected by a crossbar 419. Additionally, the bearings 418 are connected to braces 420 which rigidly maintain an arm support bar 422, positioned traversely to the segment 404. During the use of the spinal dynamometer 50, the arm support bar 422 is used to hold the patient's upper arms firmly in position, thereby restricting movement of the patient's upper thoracic spine. A roller pad 424, having a longitudinal hole (not shown) defined therein is positioned between the braces 420 so that the bar 422 resides in the hole and the roller pad 424 can rotate freely about the arm support bar 422. The bearings 418 are each 10 attached to a locking means 426, for the purpose of selectively preventing the bearings 418 from sliding about the segment 404.

For the purpose of preventing motion of an exercising patient with respect to the arm support bar 422, a retaining means 428 is provided. The retaining means 428 includes a first and a second adjustable strap 430, 431, wherein each end of the straps 430, 431 has a latch 432 attached thereto. The latches 432 comprise rings, clasps, buckles, hooks, or other suitable means for fastening an end of a strap 430, 431 to a suitable location, such as the arm support bar 422.

As a specific example of the operation of the retaining means 428, the strap 430 is attached to the arm support bar 422 on the patient's right side, brought across the patient's back, over and around his/her left shoulder, and connected to the arm support bar 422 on the patient's left side. Similarly, the strap 431 is attached to the arm support bar 422 on the patient's left side, brought across the patient's back, over and around his/her right shoulder, and connected to the arm support bar 422 on the patient's right side.

An optional interconnecting member (not shown) can be utilized if additional support is desired. The interconnecting member is fastened between the straps 430, 431, spanning the patient's upper chest, and operates to maintain the straps 430, 431 at a constant distance from each other.

Also to provide additional support, an optional chest restraining belt (not shown) can be utilized. The chest restraining belt is passed around the girth of the patient and removably attached to the arm support bar 422.

Another optional component of the assembly 400 is the head support stand 434. The stand 434 projects from an upper end of the segment 404 and is slidably adjustable in height. The position of the stand 434 can be selectively locked by a locking means 436, which is attached to the stand. Attached to the stand 434 is a padded head rest 460 having an adjustable head restraining belt 466 attached thereto.

Having described the structure of the first embodiment of the invention, the operation of the first embodiment will now be described, with reference to FIGS. 1-3. The spinal dynamometer 50 in accordance with the present invention is used to analyze musculoskeletal conditions of a patient while the patient exercises against resistance. The invention is especially useful in evaluating physical characteristics of the lower thoracic and lumbar regions of the spine.

To initiate a typical testing session utilizing the first embodiment of the present invention, an operator first measures several of the patient's body parts while the patient is standing. In particular, the operator first measures the distance between the patient's patellar insertion and the floor. Secondly, the distance between the patient's L5-L4 vertebral region and the floor is measured. Having determined these distances, the operator can approximate the length of the patient's femur by subtracting the first distance from the second distance.

To make optimal use of the spinal exercise dynamometer 50, the patient should be positioned so that his/her spinal column is aligned coaxially with the axis 202; his/her ASIS region is arranged coaxially to the axis 302; his/her L5-L4 vertebral region is oriented coaxially to the axis 402; and the angle formed between the patient's femur and the axis 202 is approximately 30 degrees.

After taking these measurements, the operator enters the data into a computing station (not shown) which, based on this input, adjusts the position of the platform 103 and the perch 118 to optimally position the patient during testing. In addition, the computing station indicates the proper position for placement of the foot restraint 112 and the knee restraint 116.

Then, the operator adjusts the foot restraint 112 to the position indicated by the computing station, and the patient steps onto the platform 103, positioning his/her feet within the foot restraint 112. Then, the patient leans backwards to position his/her upper thigh and buttocks against the perch 118. If desired, the operator can further adjust the position of the platform 103 and the height of the perch 118 manually to position the patient more advantageously. The operator then attaches the knee restraint 116 to the lower leg brace 114 to secure the patient's knees.

Then, the upper leg restraint 128 and pelvic restraint 129 are secured around the patient and tightened. Next, the operator manually adjusts the height of the arm support bar 422 in accordance with the patient's dimensions. The patient then places his/her upper arms behind the arm support bar 422, and the operator fastens and adjusts the retaining means 428, interconnecting member, and chest restraining belt to secure the patient's torso with respect to the lateral bending assembly 400. If desired, the locking means 426 are engaged.

Then, if desired, the operator adjusts the height of the padded head rest 460, and the adjustable head restraining belt 466 is secured around the patient's head and tightened to restrict motion of the patient's head with respect to the lateral bending assembly 400.

After securing the patient to the spinal exercise dynamometer 50 in the manner shown above, the operator then enters the following information into the computing station: the location of the foot restraint 112, utilizing a distance scale (not shown) located on the foot platform 103; the location of the knee restraint 116, utilizing a distance scale (not shown) located on the lower leg brace 114; the height of the platform 103 with respect to the support housing 102, utilizing a distance scale (not shown) located on the support housing 102; the position of the perch 118 with respect to the support housing 102, utilizing a distance scale (not shown) located on the perch 118, and the position of the arm support bar 422 with respect to the lateral bending assembly 400, utilizing a distance scale (not shown) located on the lateral bending support segment 404. By storing this information in the computing station, the operator can more easily reproduce testing conditions of a particular session in future tests with the same patient. In addition, the computing station can automatically adjust the positions of the platform 103 and perch 118 in future tests.

Then, the operator instructs the patient to alternately rotate as far as comfortably possible in the directions indicated by the arrows 202*a* and 202*b*, to flex and extend as far as comfortably possible in the directions shown by the arrows 302*a* and 302*b*, and then to laterally bend as far as comfortably possible in the directions shown by the arrows 402*a* and 402*b*. During this series of movements, the computing station is able to establish the range of motion of the patient's spine about the axes 202, 302, and 402. Furthermore, while the patient exercises, the computing station is thus able to prevent the patient from exceeding his/her established ranges of motion. This is accomplished by monitoring the signals received from the rotation sensor 218, the forward flexion-extension sensor 310, and the lateral bending sensor 416, and selectively applying increased resistance with the resistance means 216, 308, and 414.

Next, the operator of the back dynamometer 50 selects an exercise program for the patient by entering various characteristics of the desired test into the computing station. The spinal dynamometer is capable of supplying isometric, passive isokinetic, or passive isodynamic resistance, and can vary the amount of resistance provided. In addition, the spinal dynamometer 50 is capable of partially or completely limiting motion of the patient in one or more directions of movement to isolate a particular area of the patient's body for analysis. This is accomplished by selectively engaging the resistance means 216, 308, and/or 414.

After the exercise program has been selected, the operator directs the patient to move in a prescribed pattern of rotation, forward flexion-extension, and lateral bending movements in accordance with the specific evaluation that is being performed.

During these exercises a variety of data is accumulated. First, during dynamic exercise the rotation sensor 218 monitors the rotation of the patient about the axis 202, and transmits this data to the computing station via a cable (not shown). Furthermore, the sensor 218 monitors the torque produced by the patient about the axis 202 during isometric exercise, and transmits this data to the computing station.

During the exercises the forward flexion-extension sensor 310 also collects data. In particular, during dynamic exercise the sensor 310 monitors the forward and rearward flexion and extension of the patient about the axis 302, and transmits this data to the computing station via a cable (not shown). Furthermore, the sensor 310 monitors the torque produced by the patient about the axis 302 during isometric exercise, and transmits this data to the computing station.

Likewise, during dynamic exercise the lateral bending sensor 416 monitors the lateral bending of the patient about the axis 402, and transmits the resultant data to the computing station via a cable (not shown). Furthermore, the sensor 416 monitors the torque produced by the patient about the axis 402 during isometric exercise, and transmits this data to the computing station.

By performing a number of calculations that are well-known in the art, the data obtained as described hereinabove can then be used to determine the patient's strength; the patient's range of motion about the axes 202, 302 and 402; the torque generated about each axis by the patient; and the patient's endurance.

Having described the structure and operation of the first preferred embodiment of the invention, a second preferred embodiment will now be described. The primary component of the second embodiment of the invention is a neck exercise dynamometer 600 shown in FIGS. 4–5.

Figure 5:
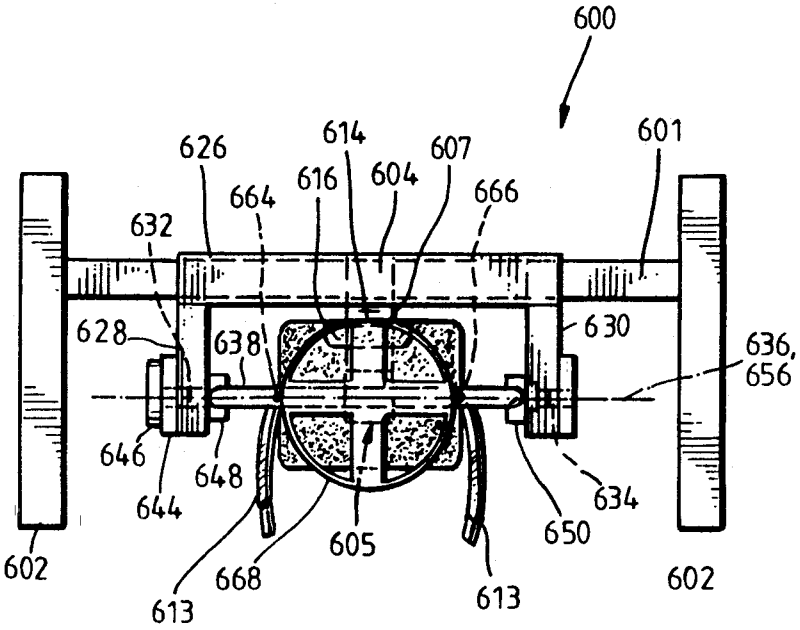
FIG. 5 is a top view of the neck exercise dynamometer 600 in accordance with the second embodiment of the invention.
Figure 4:
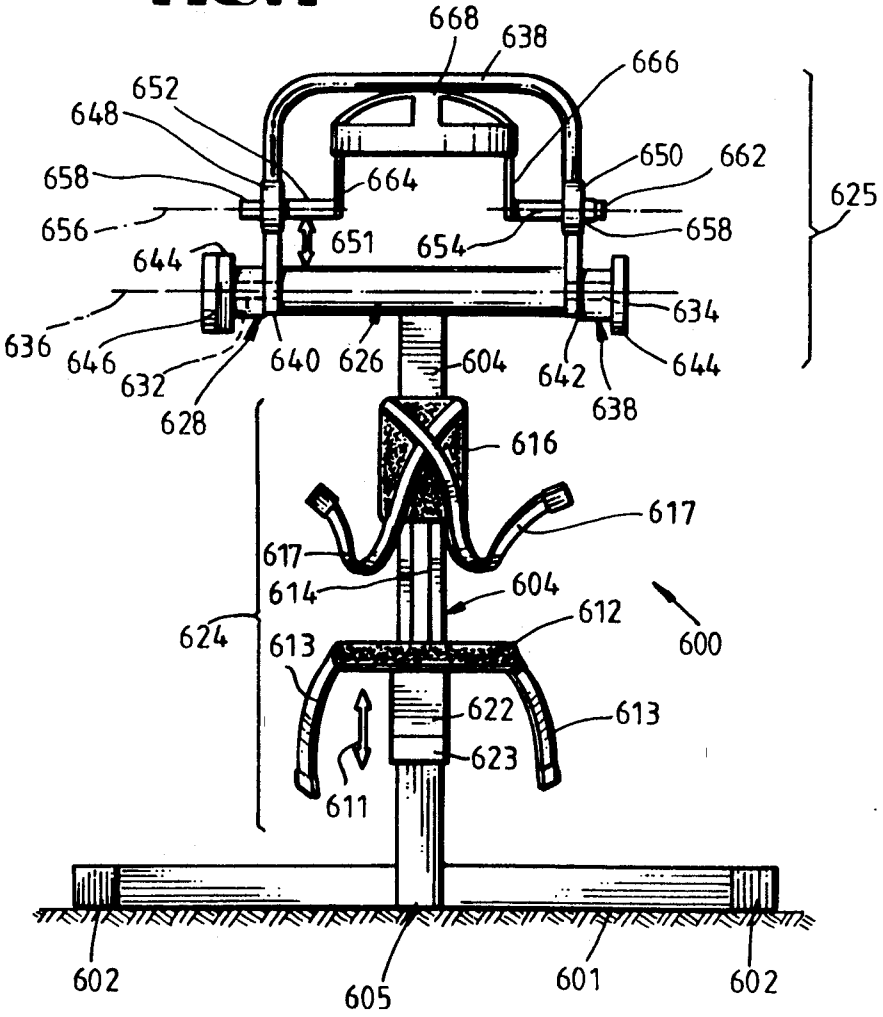
FIG. 4 is a front view of a neck exercise dynamometer 600 in accordance with a second embodiment of the invention.

Referring now to FIGS. 4–5, the neck exercise dynamometer 600 includes a primary base member 601 each end of which is attached to a secondary base member 602. The base members 601–602 provide a stable foundation for the operative components of the neck exercise dynamometer 50.

An upright support member 604 is attached at an end thereof to the base member 601. Also attached to the base member 601 is a horizontal support member 607, to which is attached a seat post 605 of square cross-section. A seat 612 is slidably mounted to the post 605, so as to permit the seat 612 to be raised or lowered in the directions indicated by arrow 611. The seat 612 is attached to a belt 613 for the purpose of securing a patient to the seat 612. The seat 612 is further connected to a vertical member 614 to which a padded back rest 616 is attached. One or more straps 617 are fastened to the back rest 616.

A seat adjusting means 622 is attached to the seat 612 and the seat post 605. The seat adjusting means 622 is capable of adjusting the elevation of the seat 612 with respect to the post 605. Attached to the seat adjusting means 622 is an elevation sensor 623, which comprises an electrical, mechanical, optical, or other type of sensing device suitable for providing an electrical signal indicative of the position of the seat 612 with respect to the post 605.

The seat 612, vertical member 614, padded back rest 616, straps 617, seat adjusting means 622, and elevation sensor 623 will be referred to collectively as a seat assembly 624.

At the upper end of the support member 604 are affixed a number of components that attach to the patient's head (not shown) and additionally facilitate the exercise of the patient's neck. These components will be collectively referred to as a head engagement assembly 625.

A principal component of the head engagement assembly 625 is a frame member 626, which is bisected by the support member 604 and mounted transversely thereto. The frame member 626 includes a first section 628 and a second section 630. The sections 628 and 630 have cylindrical apertures (not shown) formed therein, wherein a first lower shaft 632 and a second lower shaft 634 reside. The shaft 632 is surrounded by a linear bearing (not shown) which is rigidly connected to the section 628, thereby permitting the shaft 632 to freely rotate about an axis 636. Similarly, the shaft 634 is surrounded by a linear bearing (not shown) which is rigidly connected to the section 630, thereby permitting the shaft 634 to freely rotate about the axis 636.

The head engagement assembly 625 additionally includes a rotation arm 638 having a first end 640 and a second end 642. The first end 640 is connected to the shaft 632 and the second end 642 is connected to the shaft 634, thereby facilitating the rotation of the arm 638 about the axis 656.

In the preferred embodiment, dual resistance means 644 are coupled to the intersection between the section 626 and the arm 638, although it is understood that a single resistance means can be utilized. Included in each resistance means 644 is a primary gear (not shown) attached to the shaft 632 or shaft 634, a secondary gear (not shown) engaged with the primary gear, and a brake (not shown) engaged with the secondary gear. This brake comprises an electromagnetic particle brake, mechanical brake, hydraulic actuator, electric motor, friction brake, pneumatic brake, or other suitable means for providing variable resistance against rotation of the arm 638.

One of the resistance means 644 is connected to a first sensor 646, which includes two components. The first component comprises an electrical, mechanical, optical, or other type of sensing device suitable for providing an electrical signal indicative of the position of the arm 638 with respect to the frame member 626. The second component is a static torque sensor such as a quartz strain gauge or other type of sensing device capable of detecting the torque experienced by the joint between the arm 638 and the frame member 626 during isometric testing, i.e., when the arm 638 and frame member 626 are stationary with respect to each other.

The arm 638 has a number of components attached thereto. In particular, a first shaft support means 648 and a second shaft support means 650 are slidably mounted to the arm 638. The shaft support means 648, 650 include locking means (not shown), for the purpose of selectively locking the means 648, 650 to the arm 638, or permitting the means 648, 650 to slide in either direction shown by an arrow 651.

Furthermore, in the preferred embodiment, at least one of the shaft support means 648, 650 includes a position detector (not shown) which comprises a linear sensing device such as a linear potentiometer or other means capable of providing an electrical signal indicative of the position of the shaft support means 648, 650 with respect to the arm 638.

The shaft support means 648, 650 are further attached to the upper shafts 652 and 654 so as to permit the shafts 652 and 654 to rotate about an axis 656. Dual resistance means 658, of similar construction to the resistance means 644, are coupled to the intersection between the shaft support means 648, 650 and the upper shafts 652, 654. However, it is contemplated that a single resistance means can be utilized. The resistance means 658 include brakes which comprise components such as electromagnetic particle brakes, mechanical brakes, hydraulic actuators, electric motors, friction brakes, pneumatic brakes, or another suitable means for selectively providing various resistance to the rotation of the shafts 652 and 654.

To the shaft 654 is affixed a second sensor 662, which includes two components. The first component comprises an electrical, mechanical, optical, or other type of sensing device suitable for providing an electrical signal indicative of the angular position of the shaft 654 with respect to the arm 638. The second component is a static torque sensor such as a quartz strain gauge or other type of sensing device capable of detecting the torque experienced by the joint between the shaft 654 and the arm 638 during isometric testing, i.e., when the shaft 654 and the arm 638 are stationary with respect to each other.

The shafts 652 and 654 are further attached to head engagement supports 664 and 666, which are fastened to a flexible adjustable head engagement 668. The head engagement 668 is used to securely couple the patient's head to the head engagement assembly 625.

Having described the structure of the second embodiment of the invention, the operation of the second embodiment will now be described with reference to FIGS. 4–5. As mentioned hereinabove, the present invention is used to analyze musculoskeletal conditions of a patient while the patient exercises against resistance. The second embodiment of the invention is especially useful in evaluating physical characteristics of the cervical spine.

To initiate a typical testing session utilizing the second embodiment of the present invention, the operator positions the seat assembly 624 according to the mode of exercise desired. The neck dynamometer 600 accommodates multiple exercise modes including forward flexion-extension and lateral bending of the neck. To facilitate the forward flexion-extension exercise, the seat assembly 624 is positioned as shown in FIG. 4. To configure the neck dynamometer 600 for lateral bending exercises, the seat assembly 624 is removed from the post 605 and replaced so that the seat assembly 624 faces either the first section 628 or the second section 630. For ease of understanding, the discussion hereinbelow will specifically refer to the forward flexion exercise mode.

Next, the operator instructs a computing station (not shown) to adjust the seat 612, utilizing the seat adjusting means 622, so that when the patient sits on the seat 612, the patient's C7 vertebra is aligned with the axis 636. Then, the patient sits on the seat 612 and snugly fastens the seat belt 613. Next, the straps 617 are placed around the patient's thorax and tightened to secure the patient's upper torso to the padded back rest. Then, the flexible head engagement 668 is placed around the patient's head and tightened so that the C1–C2 joint of the neck is aligned with the axis 656.

After positioning the patient as described hereinabove, the operator determines the position of the seat 612 with respect to the seat post 605, utilizing a distance scale (not shown) located on the post 605. Then, the operator enters this data into the computing station. In future tests, the computing station can utilize this data to adjust the elevation of the seat assembly 624 in accordance with the patient's particular requirements.

After securing the patient to the neck exercise dynamometer 600 as described hereinabove, the operator instructs the patient to move his/her head forward, and then backward as far as comfortably possible so that the computing station is able to establish the range of motion of the patient's neck about the axes 636 and 656. During exercise of the patient, the computing station is then able to prevent the patient from exceeding his/her established ranges of motion. This is accomplished by monitoring the signals received from the sensors 646, 662, and selectively increasing the resistance supplied by the resistance means 644 and 658.

The operator of the neck dynamometer 600 then selects an exercise program for the patient by entering various characteristics of the desired test into a computing station (not shown). The neck dynamometer 600 is capable of supplying passive isodynamic, passive isokinetic, or isometric exercise and can vary the amount of resistance provided. In addition, the dynamometer 600 is capable of partially or completely limiting motion of the patient about one or both of the axes 636, 656 as well as isolating a particular area of the patient's body for analysis. In particular, by applying more resistance with the means 658, motion about the axis 656 is restricted and the exercise performed by the C1–C2 region is increased. Likewise, by applying more resistance with the means 644, the motion about the axis 636 is restricted and the exercise performed by the C3–C7 region is increased.

After the exercise program has been selected, the operator directs the patient to move his/her head in a prescribed forward or backward pattern, in accordance with the specific evaluation that is being performed. Movement of the patient during exercise is restricted to the patient's neck region due to the thoracic support provided by the padded back rest 616, the straps 617, the seat 612, and the seat belt 613.

During these exercises, a variety of data is accumulated. During dynamic exercise the first sensor 646 monitors the forward flexion of the patient about the axis 636 and transmits this data to the computing station via a cable (not shown). During isometric exercise, the sensor 646 monitors the torque produced by the patient about the axis 636, and transmits this data to the computing station. Additionally, during dynamic exercise the sensor 662 monitors the forward flexion the patient about the axis 656, and transmits this data to the computing station via a cable (not shown). During isometric exercise the sensor 662 monitors the torque produced by the patient about the axis 656, and transmits this data to the computing station. Furthermore, the position sensor included in the shaft support means 648, 650 monitors the position of the shaft sensors 648, 650 with respect to the arm 638, and transmits this data to the computing station via a cable (not shown).

The data obtained as described hereinabove can then be used to determine the patient's strength; the patient's range of motion in forward flexion-extension and lateral bending about the axes 636 and 656; the torque placed upon the neck exercise dynamometer 600 by the patient; and the patient's endurance.

The embodiments of the present invention provide a number of advantages to their users. In particular, in contrast with prior spinal dynamometers, the lumbar dynamometer 50 operates with improved accuracy since the axes 202, 302, and 402 coincide with the patient's spine. Likewise, the neck dynamometer 600, in contrast to prior arrangements, provides for more natural movement of the cervical vertebrae and facilitates more accurate testing since the neck dynamometer 600 permits simultaneous cervical motion about the axes 636 and 656.

Additionally, the lumbar dynamometer 50 operates with enhanced precision since the patient's trunk, feet, legs and arms are securely braced, thereby preventing extraneous movement of the patient, and effectively isolating the movements of the lumbar and lower thoracic spine. Likewise, the cervical dynamometer 600 operates with increased accuracy since extraneous motion of the patient is restrained by the belt 613 and the straps 617.

Still another benefit of the invention is that it is capable of accurately duplicating tests. With the lumbar dynamometer 50, the platform 103 and the perch 118 are mechanically positioned, and these settings may be recalled by the computing station. Furthermore, the adjustable head support strap 466, adjustable restraining means 428, arm support bar 422, adjustable upper leg restraint 128, pelvic restraint 129, knee restraint 116, and adjustable foot restraint 112 operate to comfortably and accurately position the patient for testing.

Likewise, tests using the cervical dynamometer 600 can be accurately reproduced since the elevation of the seat 612 is mechanically controlled and can be set by a computer. Additionally, since the invention provides improved precision as described hereinabove, the invention facilitates the accurate comparison and integration of a patient's tests, for purposes such as measuring rehabilitative progress.

Another advantage of the invention is that it selectively provides isodynamic, isometric, or isokinetic resistance. Furthermore, the invention permits users thereof to select the magnitude of resistance for exercise.

Moreover, the invention is beneficial since it facilitates isometric exercise at any posture within the patient's range of motion. Specifically, the rotation resistance means 216, forward flexion-extension resistance means 308, and flexion-extension resistance means 414 can be selectively activated in any position desired.

Yet another advantage of the invention is that the lumbar dynamometer 50 permits simultaneous tri-axial exercise of a patient. Furthermore, the exercise can be restricted to facilitate bi-axial or mono-axial movement. In one respect, this feature is useful since it can isolate a particular joint for testing, or alternatively permit compound joint actions during testing.

Additionally, the flexion-extension assembly 300, unlike prior arrangements, permits an increased range of flexion-extension of the lower spine. Furthermore, the present invention facilitates differential resistance levels for lumbar flexion and extension, and therefore better accommodates the difference between a patient's abdominal and lumbar muscle strength.

Another advantage of the present invention is that the lumbar dynamometer 50 facilitates proper isolation of the lower back during forward flexion and extension movements. Specifically, the locking means 426 can be selectively engaged to prevent the lateral bending assembly 400 from sliding along the support segment 404 during flexion and extension exercises.

A further advantage of the invention is that the neck dynamometer 600 facilitates natural movement of the patient's cervical spine, including the natural elongation of the cervical spine. In particular, since the position detector included in the shaft support means 648, 650 effectively provides the computing station with the position of the axis 656 at all times, the computing station is able to adjust the resistance supplied by the resistance means 644, 658 to compensate for the sliding of the shaft support means 648, 650 due to cervical spinal elongation during exercise. Thus, the computing station is able to facilitate more natural exercise by controlling the resistance means 644, 658, utilizing feedback provided by the position detector.

Moreover, the lumbar dynamometer 50 is safer and more accurate during flexion and extension exercises than prior arrangements due to the biasing means of the flexion-extension assembly 330. In particular, the biasing means provides a high level of accuracy since it counteracts the effect of gravity upon the lateral bending assembly 400 in the position depicted by FIGS. 1-3. In other positions, the resistance means 216, 308, and 414 can be selectively engaged, depending upon the degree to flexion or extension, to ensure that the patient's exercise is not distorted by gravitational biasing of the lateral bending assembly 400.

While there have been shown what are presently considered to be preferred embodiments of the invention, it will be apparent to those skilled in the art that various changes and modifications can be made herein without departing from the scope of the invention as defined by the appended claims.

What is claimed is:

1. An exercise apparatus, comprising:

a rotation arm including a first end region, a second end region, and a middle section;

a support unit pivotably connected to the rotation arm, to permit rotation of the rotation arm about a vertical rotation axis extending through the middle section;

a perch to position a patient's spine substantially coaxially with the rotation axis;

a flexion-extension arm including third and fourth end regions pivotably fastened to the first and second end regions to permit rotation of the flexion-extension arm about a horizontal flexion-extension axis extending through said first, second, third, and fourth end regions, and further extending perpendicularly through the rotation axis;

a lateral bending support segment including a fifth end region pivotably fastened to the flexion-extension arm to permit rotation of the lateral bending support segment about a horizontal lateral bending axis extending through said fifth end region and perpendicularly through both the rotation and flexion-extension axes, wherein the rotation arm, flexion-extension arm, and lateral bending support segment are simultaneously rotatable about their respective axes; and an arm support assembly connected to the lateral bending support segment, to limit movement of the patent's upper body with respect to the lateral bending support segment.

2. The exercise apparatus of claim 1, further comprising first resistance means for resisting motion of the rotation arm about the rotation axis.

3. The exercise apparatus of claim 1, further comprising second resistance means for resisting motion of the flexion-extension arm flexion-extension axis.

4. The exercise apparatus of claim 1, further comprising third resistance means for resisting motion of the lateral bending support segment about the lateral bending axis.

5. The exercise apparatus of claim 1, further comprising a sensor for determining angular position of the rotation arm with respect to the rotation axis.

6. The exercise apparatus of claim 1, further comprising a sensor for determining angular position of the flexion-extension arm with respect to the flexion-extension axis.

7. The exercise apparatus of claim 1, further comprising a sensor for determining angular position of the lateral bending support segment with respect to the lateral bending axis.

8. The exercise apparatus of claim 1, wherein the arm support assembly restricts motion of the patient's arms.

9. The exercise apparatus of claim 1, further comprising a sensor for determining the position of the perch.

10. The exercise apparatus of claim 1, further comprising computing means for receiving information regarding positioning of one or more of the following: the rotation arm, the perch, the flexion-extension arm, the lateral bending support segment, and the arm support assembly.

11. The exercise apparatus of claim 1, wherein the perch intersects the rotation axis at an oblique angle and is adjustable along the rotation axis.

12. The exercise apparatus of claim 1, wherein the arm support assembly restrains the patient's elbows in a position substantially behind the patient's back.

13. The exercise apparatus of claim 1, wherein the arm support assembly comprises:

an arm support bar to restrain the patient's elbows in a position substantially behind the patient's back, wherein the arm support bar is slidable in a direction parallel to the first axis; and a lock for selectively preventing the sliding of the arm support bar.

14. The exercise apparatus of claim 1, additionally comprising:

a foot platform to support the patient's feet, wherein the foot platform is adjustable along the rotation axis.

* * * * *

UNITED STATES PATENT AND TRADEMARK OFFICE

CERTIFICATE OF CORRECTION

PATENT NO. : 5,324,247
DATED : June 28, 1994
INVENTOR(S) : Jan C. Lepley

It is certified that error appears in the above-indentified patent and that said Letters Patent is hereby corrected as shown below:

Column 3, Line 44, after "strength" add --,--;

Column 4, Line 59, after "rotation" add --axes.--;

Column 4, Line 64, change "Mcintyre" to --McIntyre--;

Column 4, Line 65, change "Mcintyre" to --McIntyre--;

Column 9, Line 34, after "each" delete --10--;

Column 18, Line 6, after "arm" insert --about the--.

Signed and Sealed this

Eighteenth Day of October, 1994

*Attest:*

Bruce Lehman

BRUCE LEHMAN

*Attesting Officer*

*Commissioner of Patents and Trademarks*